US009205938B2

(12) United States Patent
Stein et al.

(10) Patent No.: US 9,205,938 B2
(45) Date of Patent: Dec. 8, 2015

(54) SYSTEM AND METHOD FOR APPLYING STRAPPING TO BALES OF MATERIAL

(71) Applicants: Del Bradley Stein, Shorewood, IL (US); James Andrew Ross, Waterman, IL (US)

(72) Inventors: Del Bradley Stein, Shorewood, IL (US); James Andrew Ross, Waterman, IL (US)

(73) Assignee: SAMUEL STRAPPING SYSTEMS, INC., Woodridge, IL (US)

( * ) Notice: Subject to any disclaimer, the term of this patent is extended or adjusted under 35 U.S.C. 154(b) by 487 days.

(21) Appl. No.: 13/745,114

(22) Filed: Jan. 18, 2013

(65) Prior Publication Data

US 2013/0180416 A1 Jul. 18, 2013

Related U.S. Application Data

(60) Provisional application No. 61/588,019, filed on Jan. 18, 2012, provisional application No. 61/684,349, filed on Aug. 17, 2012.

(51) Int. Cl.
*B65B 13/04* (2006.01)
*B65B 13/06* (2006.01)

(52) U.S. Cl.
CPC ..... *B65B 13/06* (2013.01); *B65B 13/04* (2013.01)

(58) Field of Classification Search
CPC ..... B65B 13/04; B65B 13/06
USPC ..... 100/26, 349; 53/589
See application file for complete search history.

(56) References Cited

U.S. PATENT DOCUMENTS 3,613,557 A * 10/1971 Coleman ..... 100/26
4,520,720 A * 6/1985 Urban et al. ..... 100/26
4,611,534 A 9/1986 Kudlicka et al.
6,499,525 B1 * 12/2002 Lai ..... 156/580

(Continued)

FOREIGN PATENT DOCUMENTS

DE 199 12 940 9/2000
KR 20-0251256 11/2001
KR 10-0488162 5/2005

OTHER PUBLICATIONS

International Search Report and Written Opinion for PCT Application No. PCT/US2013/022064, issued May 8, 2013, 9 pages.

(Continued)

*Primary Examiner* — Jimmy T Nguyen
(74) *Attorney, Agent, or Firm* — Foley & Lardner LLP

(57) ABSTRACT

A system and method for applying plastic strapping to bales of material. A strap track assembly comprises a frame, a track, and a flap assembly. The frame is frame sized and configured to permit a bale of material to pass therethrough. The track is coupled to and positioned along an inner surface of the frame, with the track sized and configured to house a length of strapping material therein. The flap assembly is operatively connected to a portion of track positioned along a lower portion of the frame, with the flap assembly including a first flap in selective contact with a second flap. The first flap may be constructed of a metallic material, and the second strap may be constructed of an elastomeric material such as rubber. A debris cover may be operatively connected to a front surface of the frame, with a portion of the debris cover positioned above at least a portion of the track so as to inhibit individual pieces of baled material from contacting the flap assembly and/or the track. Individual plates may be operatively connected to and extend away from an exit portion of an associated baler.

9 Claims, 5 Drawing Sheets

(56) References Cited

U.S. PATENT DOCUMENTS

| | | | | |
|---|---|---|---|---|
| 6,553,900 | B1 | 4/2003 | Daniel et al. | |
| 6,902,367 | B2 | 6/2005 | Hataya | |
| 6,990,895 | B2 * | 1/2006 | Powers | 100/27 |
| 7,237,478 | B1 * | 7/2007 | Gosis et al. | 100/26 |
| 7,757,468 | B2 * | 7/2010 | Kastner | 53/589 |
| 2001/0042355 | A1 | 11/2001 | Yamamoto et al. | |
| 2003/0024404 | A1 | 2/2003 | Daniel et al. | |

OTHER PUBLICATIONS

Supplementary European Search Report issued for European Patent Application No. 13738879.9, Sep. 21, 2015, 5 pages.

* cited by examiner

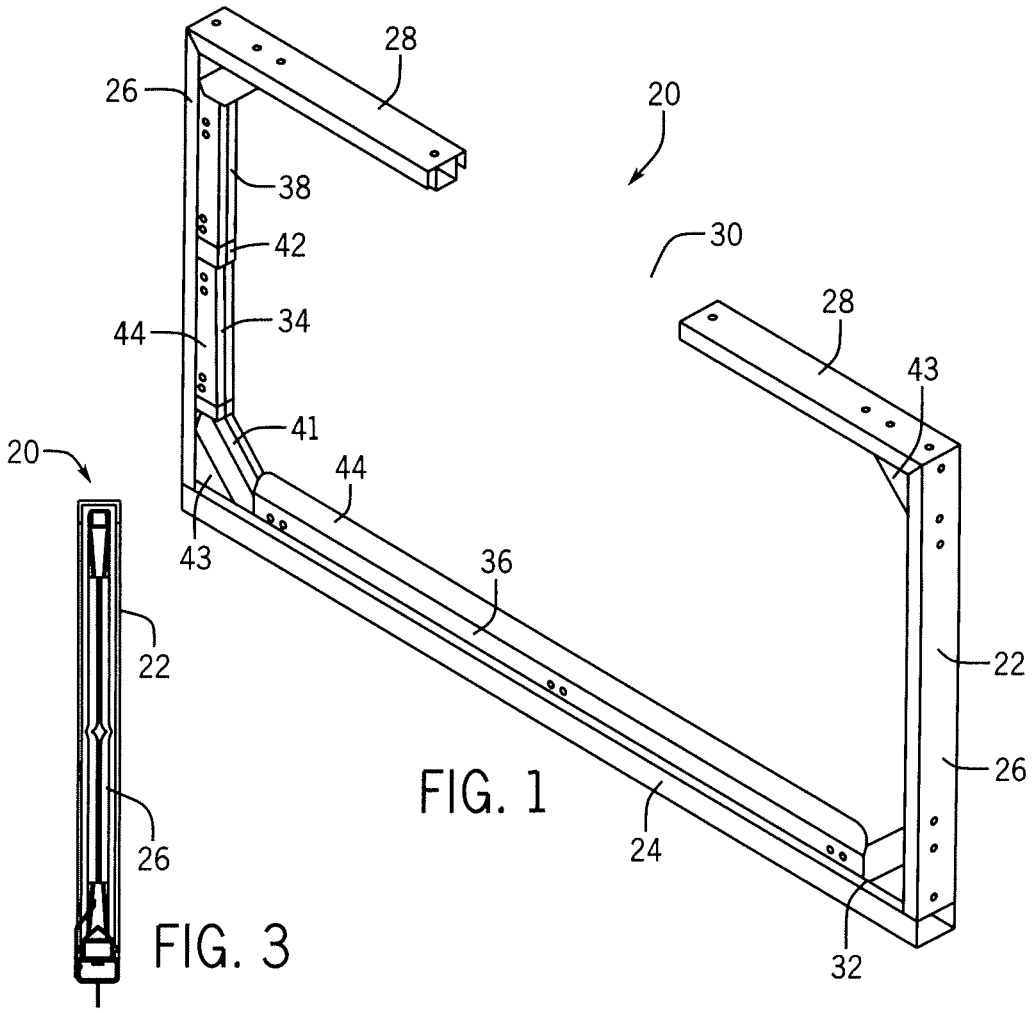
FIG. 1
FIG. 3
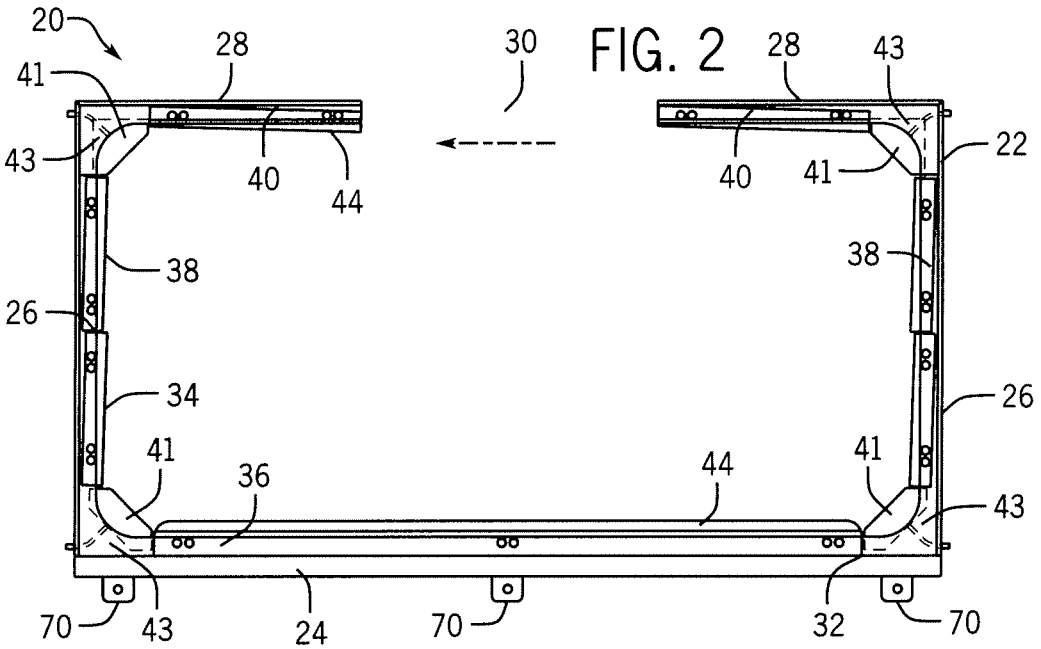
FIG. 2

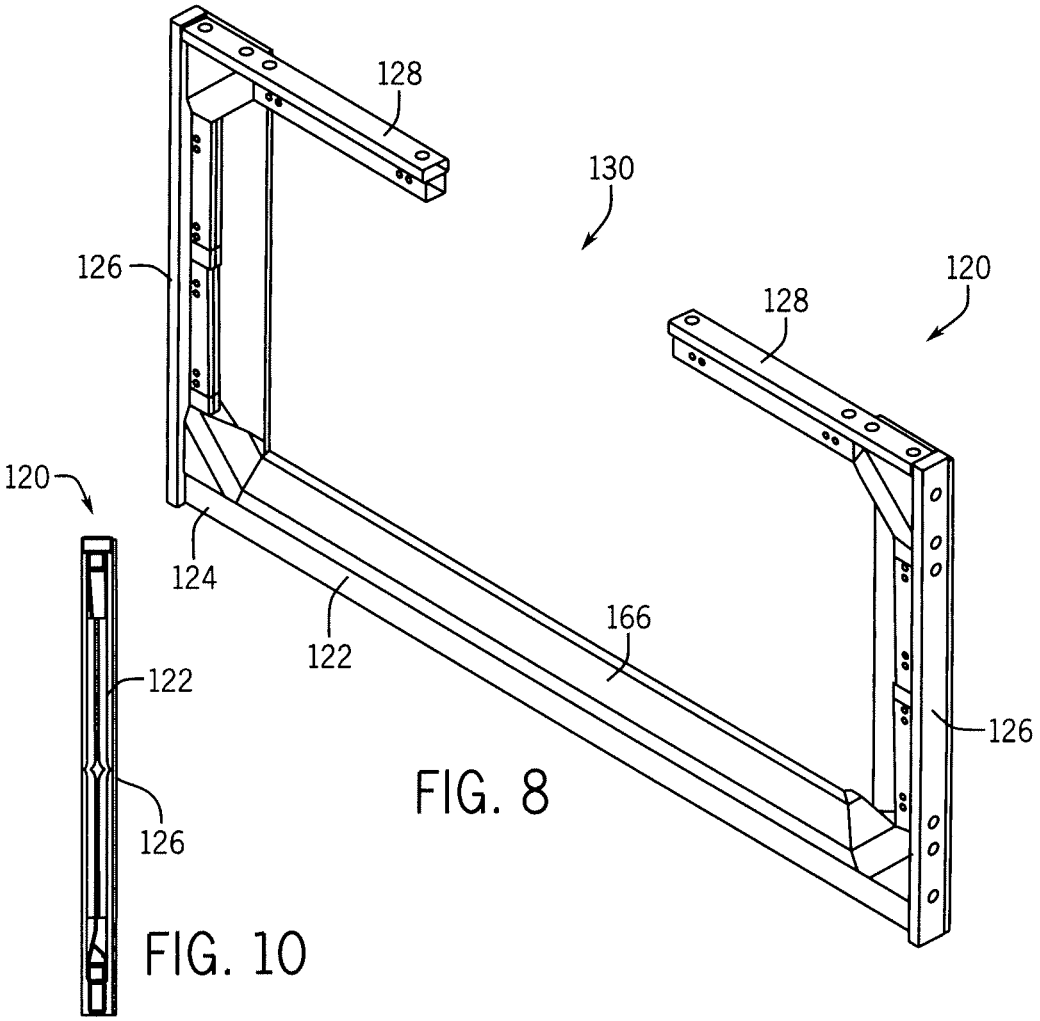
FIG. 8
FIG. 10
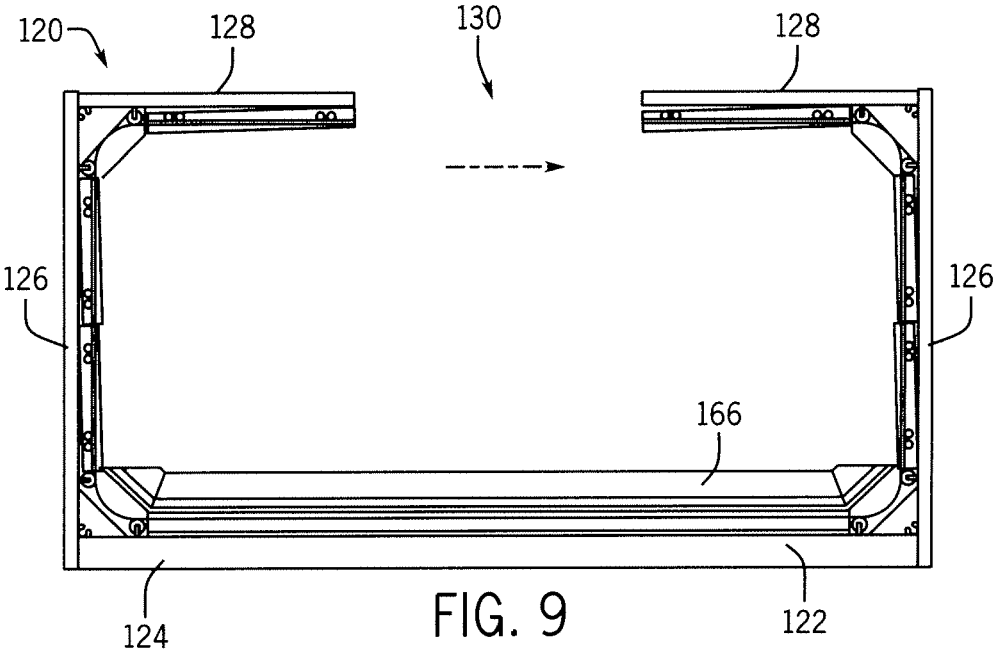
FIG. 9

SYSTEM AND METHOD FOR APPLYING STRAPPING TO BALES OF MATERIAL

CROSS-REFERENCE TO RELATED APPLICATIONS

The present application claims priority to U.S. Provisional Patent Application No. 61/684,349, filed Aug. 17, 2012. The present application also claims priority to U.S. Provisional Patent Application No. 61/588,019, filed Jan. 18, 2012. The contents of these applications are incorporated herein by reference in their entirety.

BACKGROUND

The present invention relates to strapping systems. More particularly, the present invention relates to systems for strapping and binding baled materials.

Strapping systems are often used to bind and secure various types of materials after they have been compressed and formed into a bale. In many strapping applications, individual bales of materials are bound with metal wire immediately after the bale has been created, with individual bands of metal wire being secured, as needed, along the length of the bale in order to maintain the bale in formed and compressed state. Although metal wiring adequately performs its function of securing the baled material and preventing the bulk of the bale from falling apart, the material cost for the metal wire is relatively high. Additionally, metal wire cannot be used to bind bales of garbage or solid waste that are used as refuse derived fuel (RDF), since the wire would survive the incineration process intact.

SUMMARY

Various embodiments provide a system and method for applying plastic strapping to bales of material. Once a bale of material has been created, it immediately passes from a baler to a strap track assembly positioned below a strap head. The strap track assembly includes a frame that surrounds a majority of the bale as it passes through the strap track assembly. A track is positioned on the inner surface of the frame and is configured such that plastic strapping may pass therethrough. Along the track, first and second flap members selectively contact each other in manner such that the plastic strapping may exit the track by passing between the flap members during the strapping process, while remaining concealed within the track when no strapping is taking place. On the portion of the track which runs along the lower portion of the frame, one flap member may be constructed stainless steel, carbon steel and other metals, while the other flap member may be constructed of rubber or a similar flexible material. In this arrangement, the flap members remain in contact with each at each point along the lower portion of track except when the strapping is passing therebetween during the strapping process. Additionally, while the upper and side portions of the frame may have a "C channel" configuration, with the track running within the channel, the lower portion of the frame may have a tubular construction, with the track running along the top surface of the frame's lower portion, in order to prevent individual pieces of baled material from falling onto and interfering with the track. A debris cover may also be coupled to a front surface of the frame's lower portion, with a portion of the front debris cover being positioned between the bale of material and the track, thereby inhibiting pieces of baled material from contacting and interfering with the track.

Various embodiments also provide for a system for applying plastic strapping to bales of material. A strap track assembly is operatively connected to the exit portion of a baler, with a strap head positioned above the strap track assembly to implement the strapping process. According to various embodiments, upper and lower plates are coupled to the exit portion of the bailer, with each plate passing through a region defined by the strap track assembly. The upper plate is positioned above a space that is occupied by the bale during the strapping process, and the lower plate is positioned below a space that is occupied by the strapping process. The upper and lower plates help to prevent individual pieces of baled material from coming into contact and interfering with the strap head and the strap track assembly's lower track, respectively. During the strapping process, the strapping wraps around both the upper plate and the lower plate, with the bale of material therebetween. As the baled materials is pushed through and out of the strap track assembly, the strapping slides off of the upper and lower plates and onto the baled material.

Strapping systems of the type described herein may be used, in various embodiments, to bind bales of garbage/solid waste, recyclable plastics such as plastic bottles, plastic films, corrugated paper products, carpet remnants, solid animal waste, nonferrous metals (for example, aluminum cans), scrap carpet and agricultural products such as cotton and alfalfa. Other types of materials may also be bound using the systems described herein.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

FIG. 1 is a perspective view of a strap track assembly constructed according to a particular embodiment.

FIG. 2 is a front view of the strap track assembly of FIG. 1.

FIG. 3 is a side view of the strap track assembly of FIG. 1.

FIG. 8 is an isometric view of a strap track assembly constructed according to an additional embodiment.

FIG. 9 is a front view of the strap track assembly of FIG. 8.

FIG. 10 is a side view of the strap track assembly of FIG. 8.

DETAILED DESCRIPTION OF VARIOUS EMBODIMENTS

Figure 4:
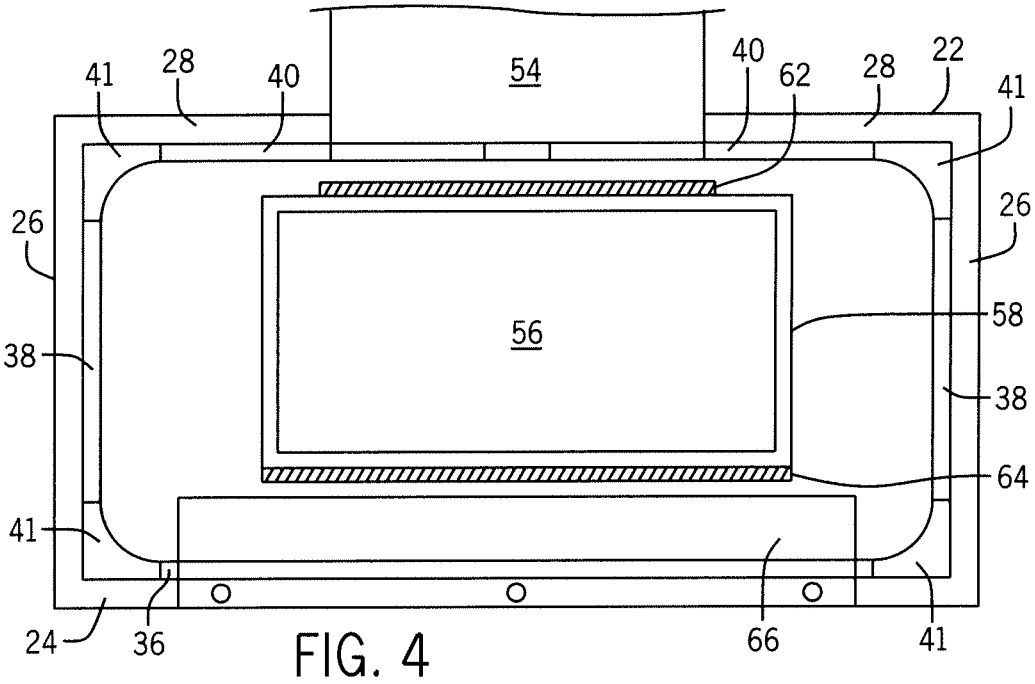
FIG. 4 is a front view showing a system for strapping a bale of material according to various embodiments.

FIGS. 1-3 show perspective, front and side views of a strap track assembly 20 according to various embodiments. The strap track assembly 20 comprises a frame 22 having a frame lower portion 24, frame side portions 26, and frame upper portions 28. An opening 30 separates the respective frame upper portions 28 from each other so that a portion of a strap head 54 (shown in FIGS. 5-6) can fit therein. The frame 22 is of a size such that an individual bale of material can pass therethrough such that a strapping process may be implemented. The frame may material be constructed of, for example, metallic materials such as carbon steel, brushed polished steel or stainless steel. The choice of material may depend upon the particular material being baled and various environmentaland cost considerations.

Figure 12:
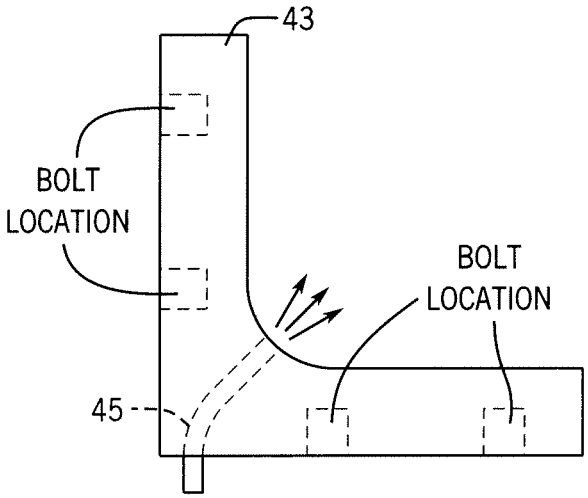
FIG. 12 is a representation of a corner member constructed according to a particular embodiment

A track 34 is coupled to and positioned along an inner surface 32 of the frame 22. The track 34 is sized and configured to house a length of strapping material therein. The track 34 comprises a track lower portion 36 (positioned along the frame lower portion 24), track side portions 38 (positioned along the frame side portions 26), track upper portions 40 (positioned along the frame upper portions 28) and track corner portions 41 (positioned at the respective corners of the frame 22). The track 34 may be constructed of carbon steel or stainless steel. In certain use scenarios, such as where garbage and solid waste are being baled, stainless steel may be preferable so as to minimize potential corrosion. In other implementations where corrosion is not a concern, lower cost carbon steel or other materials may be desirable. In the case of the track corner portions 41, these specific portions of the track 34 may rest upon and be coupled to corner members 43. The corner members may be constructed of an ultra-high molecular weight polyethylene (UHMW) or other materials that will not corrode over time. FIG. 12 is a representation of one such corner member 43 constructed according to a particular embodiment. In this particular embodiment, the two lower corner members 43 are constructed of a UHMW material and also include pipe thread fittings 45 (quarter inch fittings in one implementation). The pipe thread fittings 45 are drilled in order to allow for pressurized air to at least selectively purge the track corner portions during the strapping cycle. This arrangement also helps to reduce or even eliminate the possibility of debris from entering the track during the strapping cycle.

Figure 5:
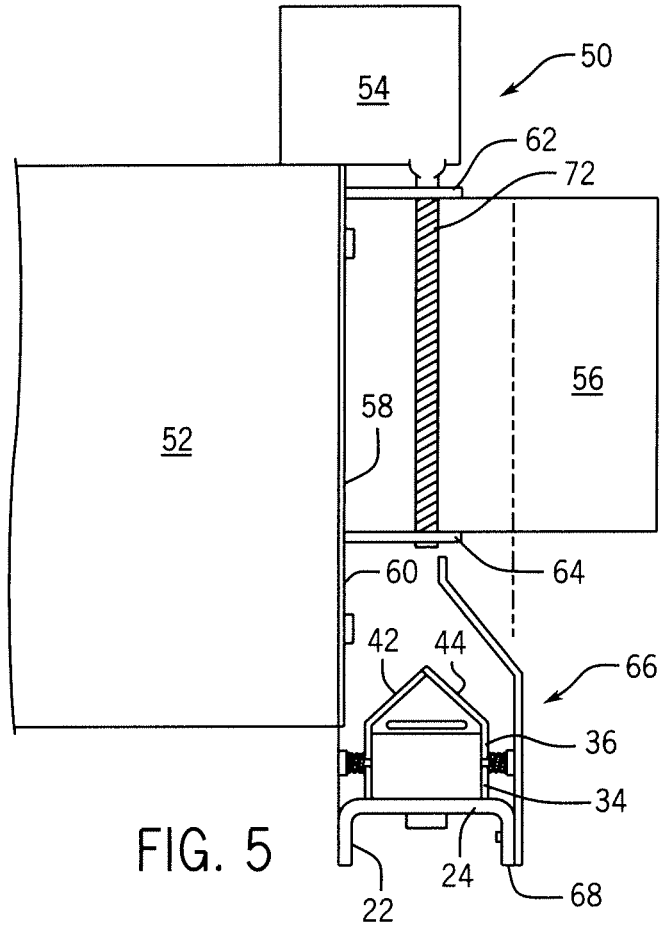
FIG. 5 is a sectional side view of the system depicted in FIG. 4.

In various embodiments, some or all of the frame 22 is constructed in a "c channel" figuration, thereby permitting the track 34 to rest within the c channel of the frame 22. Because individual pieces of baled material (particularly in the case of garbage and solid waste) may fall into a c channel in the frame lower portion 24 and subsequently interfere with the track lower portion 36, however, at least the frame lower portion 24 may instead be tubular in construction, in which case the track lower portion 36 rests on the outside surface of the frame lower portion 24. Alternatively, rather than being entirely tubular, the frame lower portion 24 can comprise a downward facing c channel such that track lower portion 36 rests on top of the frame lower portion 24 outside of the channel defined therein. This arrangement is depicted in FIG. 5.

According to various embodiments, inner flaps 42 and outer flaps 44 are operatively connected to and positioned above the longitudinal opening of the track 34 at each point thereof. As best shown in FIG. 5, the inner flaps 42 and outer flaps 44 are configured to releasably contact each other in a "rest" state. During the baling process, however, plastic strapping is capable of sliding between the inner flaps 42 and the outer flaps 44 when exiting the track 34.

In various embodiments, the outer flaps 44, along the entirety of the track 34, are constructed of a metallic material such as stainless steel (carbon steel may be used in various implementations depending upon the type of material being baled). Additionally, metallic materials such as stainless steel and carbon steel may be used for the inner flap 42 along the track side portions 38 and the track upper portions 40. In a particular embodiment, however, an elastomeric material such as rubber is used to construct the inner flap 42 along the track lower portion 36. By using an elastomeric material such as rubber, the inner flap 42 is more likely to remain in contact with the outer flap 44 at each point along the track lower portion 36 when the strapping material is not passing therebetween. This creates a stronger "seal," sharply inhibiting the ability of pieces of baled material (such as garbage) from falling off of the bale into the track 34, which in turn would interfere with the track 34 and strapping material and potentially damaging the strap track assembly 20. In contrast, if the inner flap 42 and the outer flap 44 along the track lower portion 36 were constructed of less deformable materials (at working temperatures in a baling operation) such as metal, the inner flap 42 and outer flap 44 would be more likely to separate along their entire length when strapping material is existing even a small portion of the track lower portion 36, thereby leaving an opening for individual pieces of baled material to enter.

With regard to the use of elastomeric materials for the inner flaps 42, it is possible in particular embodiments for such materials to be used in locations other than along the track lower portion 36. In particular, it is possible to use such materials for the inner flaps 42 along each of the track side portions 38 and/or the track upper portions 40 as the need arises. Additionally, in particular embodiments the elastomeric material may be used on the outer flaps 44 instead of the inner flaps 42, and the inner flaps 42 may be constructed of less pliable materials such as carbon steel and stainless steel.

FIGS. 4 and 5 are representative drawings showing the strap track assembly 20 in conjunction with a broader baling and strapping system 50. In addition to the strap track assembly 20, the baling and strapping system 20 comprises a baler 52 and the strap head 54. The baler 52 is configured to accept unbaled material and compact it into a more easily manageable bale 56 of material. A wide variety of materials may be baled according to various embodiments, including but not limited to solid waste such as garbage (including corrugated materials, fibers and municipal waste), recyclable plastic, cotton and other agricultural products, carpet remnants and scraps, solid animal waste, corrugate paper products (such as cardboard), and other products. As material is compacted into the bale 56, it is discharged from a bale exit chute 58 located on a baler exit portion 60 of the baler 52.

With regard to the strap head 54, various products are commercially available which can operative effectively in conjunction with a strap track assembly 20 as described herein. One such device is a version of the VK20/VK30 polyester strapping head marketed by Samuel Strapping Systems, with a knurled metal feed wheel being used to grip the strap. A variety of other strap heads 54 made by various companies may also be used in various embodiments.

The baling and strapping system 20 further includes an upper debris plate 62 and a lower debris plate 64, each of which is configured to further inhibit individual pieces of baled material from interfering with the strap head 54 and/or portions of the strap track assembly 20. In the embodiment depicted in FIGS. 4 and 5, the upper debris plate 62 is securely fastened to the baler exit portion 60 directly above the region in front of, and thereby defined by, the bale exit chute 58. Similarly, the lower debris plate 64 is securely fastened to baler exit portion 60 directly below the region in front of, and thereby defined by, the bale exit chute 58. This positioning of the upper debris plate 62 and the lower debris plate 64 enables the bale 56 to pass therebetween immediately upon exiting the bale exit chute 58 without the upper debris plate 62 and the lower debris plate 64 interfering with the bale exit chute 58. In particular embodiments, the coupling of the upper debris plate 62 and the lower debris plate 64 to the baler exit portion 60 can be achieved via welding.

As depicted in FIGS. 4 and 5, the upper debris plate 62 and the lower debris plate 64 extend substantially orthogonally from the baler exit portion 60 and extend at least partially into the region defined by the frame 22 of the strap track assembly 20. In particular embodiments, the upper debris plate 62 and the lower debris plate 64 extend only partially into the region defined by the frame 22. In other embodiments, the upper debris plate 62 and the lower debris plate 64 extend all of the way through this region. In the case of the lower debris plate 64, its positioning above the track lower portion 36 inhibits individual pieces of baled material from breaking off of the bale and then falling into the track 34 and potentially damaging the strap track assembly 20. Similarly, the upper debris plate 62 inhibits individual pieces of baled material from breaking off of the bale and being ejected upwards towards the strap head 54, thereby helping to prevent damage to the strap head 54.

As best shown in FIG. 5, a front debris cover 66 may also be used to inhibit pieces of baled material from falling into the track 34 during the strapping process. As depicted in FIG. 5, the front debris cover 66 may be coupled to a outer surface 68 of the frame. The front debris cover 66 extends upwards and bends inwardly as it approaches the region through which the bale 56 passes. In the particular embodiment shown in FIG. 5, the front debris cover 66 bends sufficiently inwardly such that it is ultimately positioned below the lower debris plate 64. In this arrangement, it becomes extremely difficult for pieces of baled material to even contact the inner flap 42 and the outer flap 44, much less the track lower portion, since the lower debris plate 64 and the front debris cover 66 cooperate to effectively prevent any material from dropping directly downward to the inner flap 42 and the outer flap 44 (and possibly to the track 34 therebelow). It should be noted that both the shape and coupling location of the front debris cover 66 shown in FIG. 5 is only exemplary in nature, and various modifications are possible.

Figure 6:
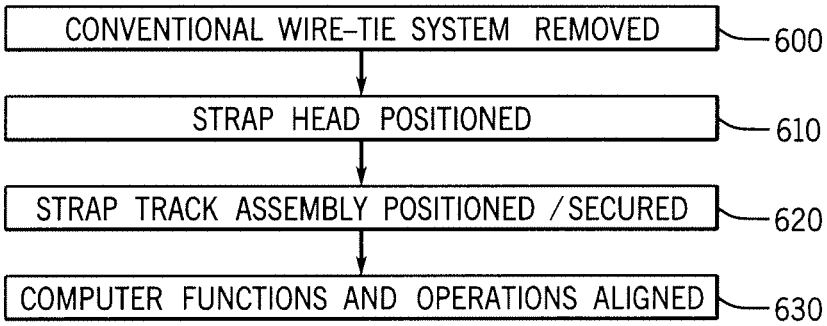
FIG. 6 is a flow chart showing a process by which an existing baling system may be retrofit with a strap track assembly constructed according to various embodiments.

FIG. 6 is a flow chart showing a process by which an existing baling system may be retrofit with a strap track assembly according to various embodiments of the type described herein. At 600 in FIG. 6, a conventional wire-tie system (where bales are bound with metallic wire) is removed from the baling system. At 610, the strap head 54 is placed in position relative to the bailer (for example, the positions shown in FIGS. 4 and 5). At 620, the strap track assembly 20 is placed in the proper position adjacent the baler exit portion 60 and is secured thereto. In a particular embodiment, alignment and securement portions 70 (best shown in FIG. 2) on the track strap assembly 20 are configured to precisely match the alignment and securement portions of the just-removed wire-tie system, thereby allowing the track strap assembly 20 to very quickly and easily align with the baler 52 without the need for substantially modifications thereto. At 630, the computerized functions of the strap head 54 are aligned with the functions of the baler 52 so that the baling and strapping processes may be coordinated and at least partially automated.

Figure 7:
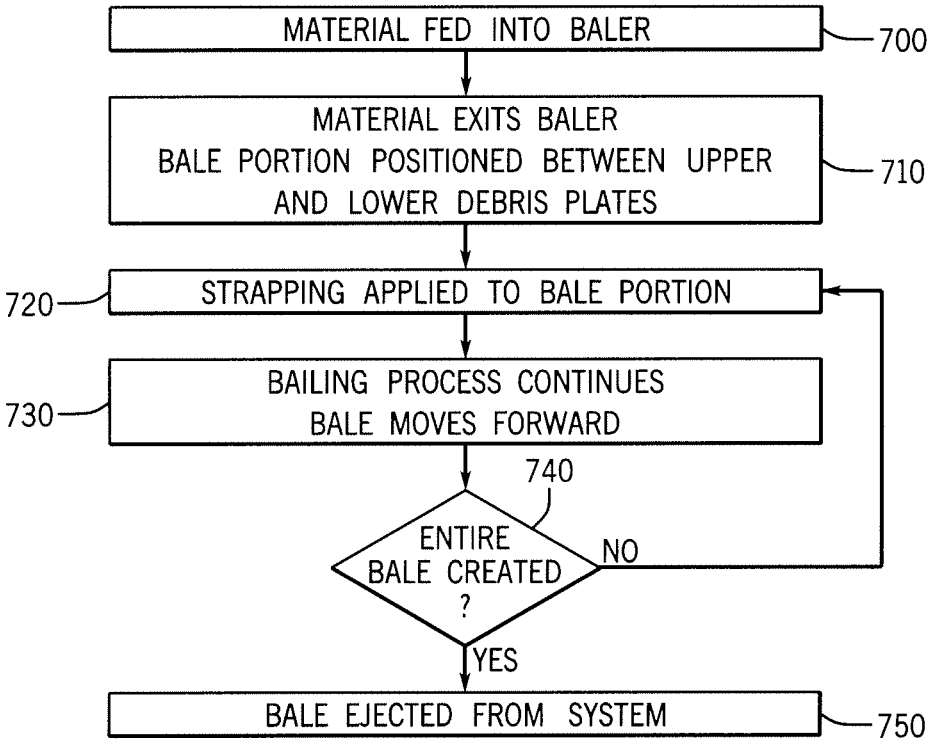
FIG. 7 is a flow chart showing a process by which material is baled and strapped according to various embodiments.

FIG. 7 is a flow chart showing a process by which material is baled and strapped according to various embodiments. At 700, the material to be baled is fed into the baler 52 and the baling process begins. At 710, the first portion of baled material begins to exit the baler 52. During this process, the bale 56 slides on top of the lower debris plate 64 and is positioned between the upper debris plate 62 and the lower debris plate 64, thereby inhibiting individual pieces of baled material from falling downward towards the track lower portion 36 or projecting upward towards the strap head 54. This also prevents the bale from expanding upward and downwards in an undesirable manner.

At 720, a strap of material is applied to the bale. This is accomplished by the strap 54 dispensing a length of strap (shown at 72 in FIG. 5) inside the track 34 of the strap track assembly 20 and then "pulling" the strap 72 such that the strap 72 passes between the inner flaps 42 and the outer flaps 44. In a particular embodiment, the strap 72 is formed of polyester, although other materials may also be used. The strap 72 is then applied to the combination of the upper debris plate 62, the bale 56 and the lower debris plate 64, and the ends of the strap 72 are secured to each other in a tight fit. At this point, the strap 72 is in contact with the upper surface of the upper debris plate 62 and the lower surface of the lower debris plate 64, rather than the upper and lower surfaces of the bale itself.

At 730, the baling process is continued, resulting in new baled material exiting from the bale exit chute 58. This pushes the baled material forward by a certain distance. In certain embodiments, the precise distance may be predetermined, for example about six inches in one implementation. In other embodiments, the distance may be based upon human discretion. While the baled material moves forward, the already-applied straps 72 slide along the upper discharge plate 62 and the lower discharge plate 64.

At 740, it is determined whether an entire bale 56 of material has been created. If not, then a new strap 72 is applied to the baled material at 750, spaced apart from the previous strap 72 by the distance that the bale 56 has moved forward. In one embodiment, a new strap 72 is applied to the bale automatically at about every 6-8 inches along the bale. For each individual strap 72, once the strap 72 has reached the end of the upper debris plate 62 and the lower debris plate 64, the strap simply slides off of the respective debris plates, and any looseness in the formed strap 72 is compensated for by a slight expansion of the bale 56 as it exits the space bound by the upper debris plate 62 and the lower debris plate 64.

If it is determined at 740 that an entire bale of 56 of material has been created and no further strapping is necessary, then the bale 56 is fully ejected from the system at 750, and the bale 56 can be transported for disposal and/or transportation to a recycling, processing or RDF facility.

FIGS. 8-11 show isometric, front, side and sectional side views of a strap track assembly 120 according to an additional embodiment. The strap track assembly 120 of FIGS. 8-11 is similar to the system depicted in FIG. 1-5 in many respects, with a number of variations as discussed below. The baling process using the strap track assembly 120 may be generally identical to the baling process depicted in FIG. 7.

The strap track assembly 120 comprises a frame 122 having a frame lower portion 124, frame side portions 126, and frame upper portions 128. An opening 130 separates the respective frame upper portions 128 from each other so that a portion of a strap head 54 (shown in FIGS. 5-6) can fit therein. The frame 122 is of a size such that an individual bale of material can pass therethrough such that a strapping process may be implemented. The frame 122 may be constructed of, for example, metallic materials such as carbon steel, brushed polished steel or stainless steel. The choice of material may depend, for example, upon the particular material being baled and various environmental and cost considerations.

A track 134 is coupled to and positioned along the frame 122. The track 134 is sized and configured to house a length of strapping material therein. The track 134 may be constructed, for example, of carbon steel or stainless steel. In certain use scenarios, such as where garbage and solid waste are being baled, stainless steel may be preferable so as to minimize potential corrosion. In other implementations where corrosion is not a concern, lower cost carbon steel or other materials may be desirable. A strap 154 is positioned adjacent an outside surface of the track 134.

Figure 11:
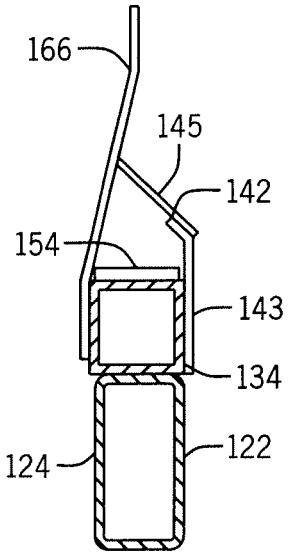
FIG. 11 is a sectional side view of the strap track assembly taken along lines A-A of FIG. 8.

As best shown in FIG. 11, a flap 142 is operatively connected to a portion of the track 134 and extends at least partially over the upper surface of the track 134 and the strap 154 (before the strap 154 is applied to the bale of material) along at least a lower portion of the strap track assembly 120. The flap 142 comprises a flap lower portion 143 coupled to a flap upper portion 145. The flap lower portion 143 may be constructed of a material such as stainless steel. The flap upper portion 145 may be constructed of heavy gauge neoprene in one particular embodiment. However, the materials for both the flap upper portion 145 and the flap lower portion 143 may vary, and the gauge thickness of the flap upper portion 145 may also vary depending upon particular system requirements. The flap upper portion 145 is flexible such that, during the strapping process, the strap 154 partially deforms the flap upper portion when exiting the void defined by the flap 142 and a debris cover 166 (discussed below).

The debris cover 166 is used to inhibit pieces of baled material from falling into the strap 154 and the track 134 during the strapping process. As shown in FIGS. 8, 9 and 11, the debris cover 166 may be coupled to the front outer surface of the at least a portion of the track 134. In the embodiment depicted in FIGS. 8-11, the debris cover 166 is positioned along the entire lower portion of the strap track assembly 120, including the lower corners thereof. The debris cover 166 is angled in a manner such that it extends at least partially over the upper surface of the track 134 and the strap 154 (before the strap 154 is applied to the bale of material). As best shown in FIG. 11, an end of the debris cover 166 contacts the flap 142 such that the track 134 and the strap 154 are generally protected from falling debris and the like. In a particular embodiment, the debris cover 166 is constructed of stainless steel, but it is possible to use other materials depending upon the particular material being baled and the general requirements of the system.

Figure 13:
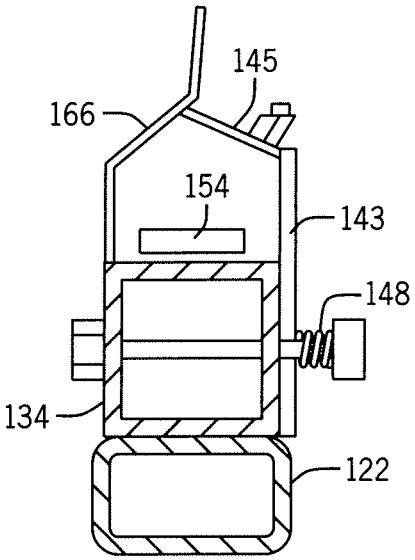
FIG. 13 is a sectional side view of the strap track assembly according to another embodiment.

FIG. 13 is a sectional side view of the strap track assembly in a slightly modified form and according to an additional embodiment. In this particular embodiment, the flap upper portion 145 comprises nylon impregnated belting. Additionally, the flap lower portion 143 is secured, in this particular embodiment, with a plurality of biasing members 148. In a particular implementation, the biasing members 148 comprise conical springs, and a total of ten such conical springs are used. The biasing members 148 permit the flap lower portion 143 to pivot to a certain extent, thereby allowing the strap 154 to exit the track 134 more easily. This embodiment can also involve the structure, configuration and operation of the corner members 43 depicted in FIG. 12.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "top," "bottom," "upper," "above," "below," etc.) are merely used to describe the orientation of various elements in the Figures. It should be noted that the orientation of various elements may differ according to other exemplary embodiments, and that such variations are intended to be encompassed by the present disclosure.

Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. Additionally, elements from different embodiments may be combined in a single implementation based upon desired engineering requirements and specifications. The order or sequence of any method processes may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A strap track assembly for use in binding bales of material with plastic strapping, comprising:

a frame sized and configured to permit a bale of material to pass therethrough;

a track coupled to and positioned along an inner surface of the frame, the track sized and configured to house a length of strapping material therein;

a flap assembly operatively connected to the track, the flap assembly comprising, at each point along the track, a first flap in selective contact with a second flap, whereby the strapping material may pass between the first flap and the second flap during the strapping process; and a debris cover operatively connected to a front surface of the frame, wherein a portion of the debris cover is positioned above at least a portion of the track so as to inhibit individual pieces of baled material from contacting at least one of the track, the first flap and the second flap.

2. A strap track assembly for use in providing plastic strapping to bales of material, comprising:

a frame sized and configured to permit a bale of material to pass therethrough;

a track coupled to and positioned along an inner surface of the frame, the track sized and configured to house a length of strapping material therein; and a flap assembly operatively connected to a portion of track positioned along a lower portion of the frame, the flap assembly including a first flap in selective contact with a second flap, whereby the strapping material may pass between the first flap and the second flap during the strapping process, wherein the first flap is constructed of a metallic material, and wherein the second strap is constructed of an elastomeric material, such that individual pieces of baled material are inhibited from entering the track by passing between the first flap and the second flap.

3. The strap track assembly of claim 2, wherein the first flap is constructed of stainless steel.

4. The strap track assembly of claim 2, the lower portion of the frame comprises a tubular member, and wherein the track is positioned on the top surface of the tubular member along the lower portion of the frame.

5. A baling assembly, comprising:

a baler configured to font a bale of material, the baler including an exit portion and a bale exit chute through which a manufactured bale exits the baler;

a first plate operatively connected to and extending away from the exit portion of the baler, the first plate positioned outside of a region defined by the bale exit chute;

a strap track assembly operatively connected to the exit portion of the baler and configured to at least partially surround the bale of material upon exiting the bale exit chute; and a strap head configured to dispense plastic strapping material via the strap track assembly for use in securing the bale of material, wherein the first plate extends away from the baler by a distance so as to be positioned between the bale of material and one of the strap track assembly and the strap head during a strapping process, thereby inhibiting individual pieces of baled material from contacting the one of the strap track assembly and the strap head.

6. The baling assembly of claim 5, further comprising a second plate operatively connected to and extending away from the exit portion of the baler, the second plate positioned outside of a region defined by the bale exit chute and being located on a side of the bale chute exit substantially opposite the first plate, wherein the second plate extends away from the baler by a difference so as to be positioned between the bale of material and one of the track assembly and the strap head during a strapping process, thereby inhibiting individual pieces of baled material from contacting the one of the track assembly and the strap head.

7. The baling assembly of claim 6, wherein the first plate is positioned above the region defined by bale exit chute, and wherein the second plate is positioned below the region defined by the bale exit chute.

8. The baling assembly of claim 5, wherein the first plate is positioned such that, during a strapping process, strapping is applied around both the bale of material and the first plate.

9. The baling assembly of claim 6, wherein the first plate and the second plate are positioned such that, during a strapping process, strapping is applied around the bale of material, the first plate and the second plate.

* * * * *